US006250230B1

(12) United States Patent
Post

(10) Patent No.: US 6,250,230 B1
(45) Date of Patent: Jun. 26, 2001

(54) APPARATUS AND METHOD FOR REDUCING INDUCTIVE COUPLING BETWEEN LEVITATION AND DRIVE COILS WITHIN A MAGNETIC PROPULSION SYSTEM

(75) Inventor: Richard F. Post, Walnut Creek, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/357,639

(22) Filed: Jul. 20, 1999

(51) Int. Cl.[7] ..... B61B 13/00

(52) U.S. Cl. ..... 104/281; 104/282; 104/284; 104/286

(58) Field of Search ..... 104/281, 282, 104/284, 286, 288, 290, 291, 292, 293, 294

(56) References Cited

U.S. PATENT DOCUMENTS

| | | | | |
|---|---|---|---|---|
| 3,952,668 | * | 4/1976 | Urankar | 104/284 |
| 4,858,513 | * | 8/1989 | Kememy | 89/8 |
| 4,913,059 | * | 4/1990 | Fujie et al. | 104/282 |
| 5,178,072 | * | 1/1993 | Suzuki | 104/286 |
| 5,189,961 | * | 3/1993 | Fujie | 104/281 |
| 5,293,824 | * | 3/1994 | Fujie et al. | 104/282 |
| 5,394,807 | * | 3/1995 | Sink | 104/292 |
| 5,605,100 | * | 2/1997 | Morris et al. | 104/284 |
| 5,628,253 | * | 5/1997 | Ozeki et al. | 104/292 |
| 5,631,618 | * | 5/1997 | Trumper et al. | 104/286 |
| 5,657,697 | * | 8/1997 | Murai | 104/284 |
| 5,669,310 | * | 9/1997 | Powell et al. | 104/281 |
| 6,044,770 | * | 4/2000 | Davey et al. | 104/282 |

* cited by examiner

*Primary Examiner*—S. Joseph Morano
*Assistant Examiner*—Lars A. Olson
(74) *Attorney, Agent, or Firm*—James M. Skorich; Alan H. Thompson

(57) ABSTRACT

An apparatus and method is disclosed for reducing inductive coupling between levitation and drive coils within a magnetic levitation system. A pole array has a magnetic field. A levitation coil is positioned so that in response to motion of the magnetic field of the pole array a current is induced in the levitation coil. A first drive coil having a magnetic field coupled to drive the pole array also has a magnetic flux which induces a parasitic current in the levitation coil. A second drive coil having a magnetic field is positioned to attenuate the parasitic current in the levitation coil by canceling the magnetic flux of the first drive coil which induces the parasitic current. Steps in the method include generating a magnetic field with a pole array for levitating an object; inducing current in a levitation coil in response to motion of the magnetic field of the pole array; generating a magnetic field with a first drive coil for propelling the object; and generating a magnetic field with a second drive coil for attenuating effects of the magnetic field of the first drive coil on the current in the levitation coil.

31 Claims, 5 Drawing Sheets

APPARATUS AND METHOD FOR REDUCING INDUCTIVE COUPLING BETWEEN LEVITATION AND DRIVE COILS WITHIN A MAGNETIC PROPULSION SYSTEM

The United States Government has rights in this invention pursuant to Contract No. W-7405-ENG-48 between the United States Department of Energy and the University of California for the operation of Lawrence Livermore National Laboratory.

CROSS-REFERENCE TO RELATED APPLICATION

This application relates to and incorporates by reference issued U.S. Pat. No. 5,722,326, entitled "Magnetic Levitation System for Moving Objects," and assigned to The Regents of the University of California (Oakland, Calif.)

BACKGROUND OF THE INVENTION

1. Field of the Invention

The present invention relates generally to apparatus and methods for magnetic propulsion, and more particularly to an apparatus and method for reducing inductive coupling between levitation and drive coils within a magnetic propulsion system.

2. Discussion of Background Art

Magnetic levitation and propulsion systems of one sort or other have been in development for some time. As is well known, these systems use electromagnetic principles to generate magnetic fields which support and/or create motion without direct physical contact between a track of some sort and an object being supported and/or propelled.

For instance, in one type of "maglev" train, electrically powered magnet coils are used to produce a levitation force, and complex control circuits are needed to maintain the separation between the poles of these magnets and the under surface of a steel guide-way from which the levitation forces are produced. The control circuitry must be highly reliable, accurate, and responsive, due to the high speeds at which such trains are designed to operate. Other Maglev systems use superconducting coils, the magnetic fields of which interact with coils in a guide-way to produce levitation. These Maglev systems thus typically come with very high manufacturing, operation, and maintenance costs.

An alternative to "maglev" technology is presented in U.S. Pat. No. 5,722,326, entitled "Magnetic Levitation System for Moving Objects," by Richard F. Post, and assigned to The Regents of the University of California, Oakland, Calif. The '326 patent describes a less costly levitation and propulsion system incorporating a track containing an array of levitation and drive coils interacting with permanent-magnet bars arranged in a "Halbach Array" that are affixed to an object to be levitated and moved.

Application of the '326 patent's technology to high-speed trains as well as new uses such as launching objects into space and various low speed people mover and mining car applications often requires high acceleration rates. Such high acceleration rates are achieved by sending large current pulses through the drive coils. Since the drive coils are interleaved with the levitation coils, current changes in the drive coils will induce parasitic current fluctuations in the levitation coils, through mutual inductive coupling. These parasitic currents can interfere with normal levitation coil currents, resulting in reduced levitation and drive performance.

In response to the concerns discussed above, what is needed is an apparatus and method for magnetic propulsion which overcomes the problems of the prior art.

SUMMARY OF THE INVENTION

The present invention is an apparatus and method for reducing inductive coupling between levitation and drive coils within a magnetic propulsion system. Within the apparatus of the present invention, a pole array creates a spatially periodic magnetic field. Levitation coils are positioned so that, in response to motion of the magnetic field of the pole array, currents are induced in the levitation coils. A first drive coil having a magnetic field coupled to drive the pole array also has a magnetic flux which induces a parasitic current in adjacent levitation coils. A second drive coil having a magnetic field is positioned to attenuate the parasitic current in the adjacent levitation coils by canceling the magnet flux of the first drive coil which induced the parasitic current.

The method of the present invention includes the steps of generating a magnetic field with a pole array for levitating an object; inducing current in a levitation coil in response to motion of the magnetic field of the pole array; generating a magnetic field with a first drive coil for propelling the object; and generating a magnetic field with a second drive coil for minimizing the effects of the changing magnetic field of the first drive coil on the currents in the adjacent levitation coils.

The apparatus and method of the present invention are particularly advantageous over the prior art because an improved drive coil geometry decouples current pulses in drive coils from levitation coils as an object attached to the pole array is propelled. Symmetric drive coils further enhance this decoupling.

These and other aspects of the invention will be recognized by those skilled in the art upon review of the detailed description, drawings, and claims set forth below.

DETAILED DESCRIPTION OF THE PREFERRED EMBODIMENT

Figure 1:
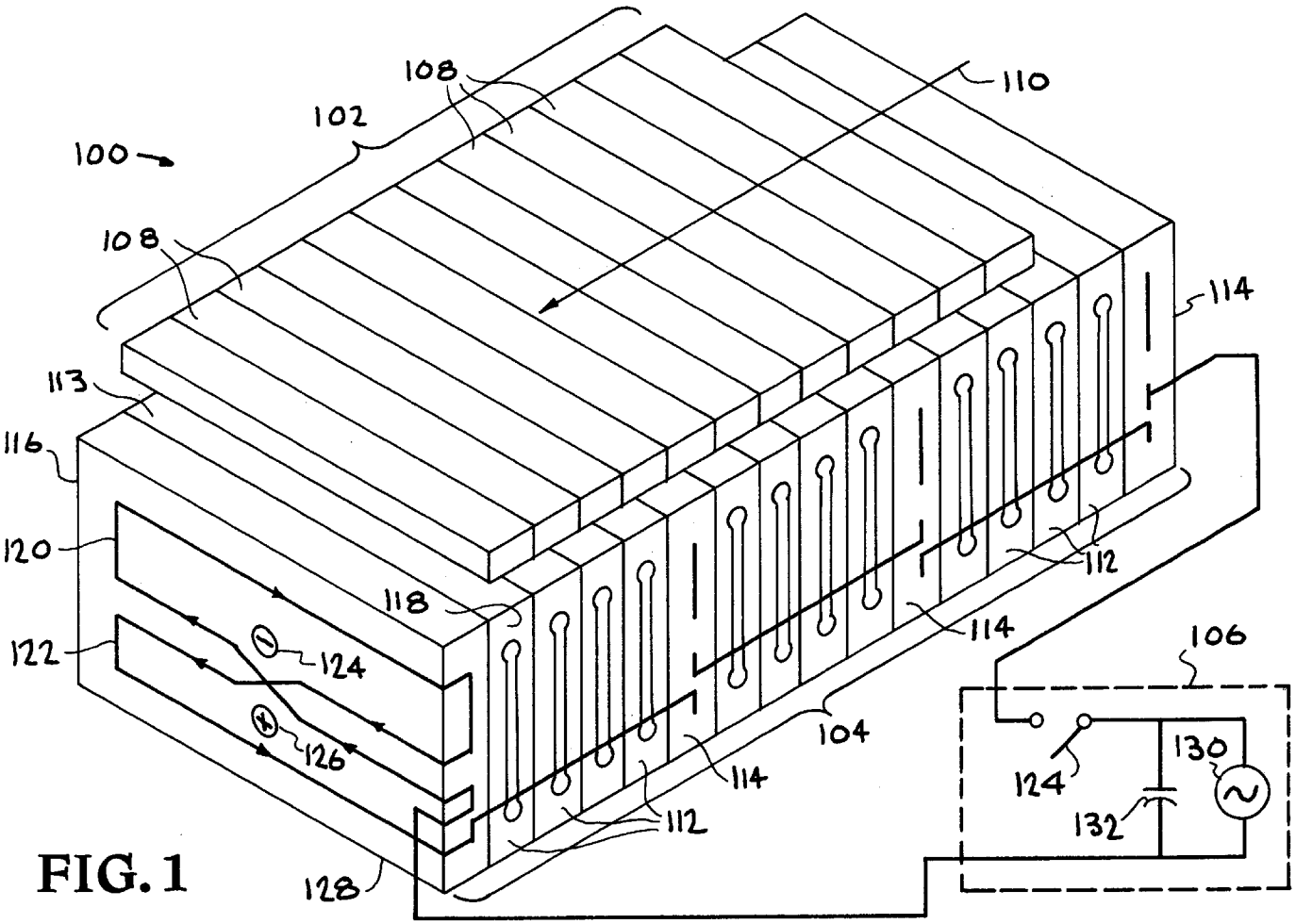
FIG. 1 is a pictorial diagram of a apparatus for reducing inductive coupling between levitation and drive coils according to one embodiment of the present invention.

FIG. 1 is a pictorial diagram of a apparatus 100 for reducing inductive coupling between levitation and drive coils according to one embodiment of the present invention.

The apparatus 100 includes a magnetic pole array 102, a track 104, and drive circuitry 106. The magnetic pole array 102 is preferably in a form of a Halbach array. The Halbach array consists of a series of either permanent or electromagnetic bars 108 oriented perpendicular to a direction of travel 110. See U.S. Pat. No. 5,722,326, entitled "Magnetic Levitation System for Moving Objects," by Richard F. Post, and assigned to The Regents of the University of California, Oakland, Calif. for a description of Halbach arrays. This patent is herein incorporated by reference. The pole array 102 is mounted on a bottom of an object (not shown) to be levitated and moved. In one embodiment, on the order of twenty bars 108 might be attached to a single train car. The pole array 102 can also include windings which could be used to modify levitation forces in response to load changes of the object.

The track 104 is stationary and includes a series of levitation coils 112 periodically interleaved with a series of drive coils 114. Each levitation coil 112 is preferably a closed loop circuit. As described in U.S. Pat. No. 5,722,326, entitled "Magnetic Levitation System for Moving Objects," which is herein incorporated by reference, the levitation coils 112 have a primary function of providing levitating forces in response to motion of the pole array 102 over a top portion 113 of the levitation coil 112. When a concentrated magnetic field, produced by the pole array 102 moves with respect to the levitation coil 112, a current is induced in the levitation coil 112. The induced current in the levitation coil generates a second magnetic field which interacts back on the magnetic field of the pole array 102, producing a repelling force which magnetically levitates the moving object attached to the pole array 102. Thus, levitation of the object occurs from motional energy of the object itself, and typically represents only a percent or two of an amount of energy required to overcome aerodynamic drag when the object moves at high speeds. The object may have a second and third pole array (not shown) facing a left side 116 and a right side 118 of the levitation coil 112 respectively. These second and third arrays can provide centering forces against sideways displacements of the object.

Each of the drive coils 114 preferably includes an upper drive coil 120 and a lower drive coil 122 electrically connected in series which are used to transmit a driving force to the object. Those skilled in the art however will know that the upper and lower coils 120 and 122 need not be connected in series, however, a close phase relationship between their currents is preferred so that magnetic fluxs generated by the coils cancel each other out.

The drive coils 114 are sequentially pulsed to provide a drive power to the object connected to and levitated by the pole array 102. An upper magnetic field generated by the upper drive coil 120 interacts with a vertical component of a magnetic field of the pole array 102 so as to drive the object in a particular direction. The upper drive coil 120 also generates an upper magnetic flux (Fu) 124. In the lower drive coil 122, current flows in an opposite direction, producing a lower magnetic field. The lower magnetic field only minimally interacts with the pole array 102 due to an exponential weakening as a distance from the pole array 102 increases. The lower drive coil 122 also generates a lower magnetic flux (Fl) 126. The lower magnetic flux 126 cancels out any influence on the levitation coils 112 that the upper magnetic flux 124 may have. Similarly, the two coils 120 and 122 function together to minimize any influence that a magnetic field from the levitation coils 112 may have on the drive coils 114. Thus, by adding the lower coil 122 mutual inductive magnetic flux coupling between the drive coils and the levitation coils is reduced and/or eliminated. Those skilled in the art however will recognize that in alternate embodiments the upper and lower drive coils 120 and 122 can be modified in shape and positioning with respect to the levitation coils 112 to reduce mutual inductive coupling by a predetermined amount.

The drive circuitry 106 includes a power source 130, an energy storage device 132, and a switch 134. Periodic closure of the switch 134 allows current to surge from the energy storage device 132 into the drive coils 114. This surge of current is timed so as to propel the pole array 102.

One embodiment of this invention is capable of propelling a 33 meter 50,000 kilogram train at 500 kilometers per hour, overcoming a 60,000 Newton drag force, while requiring about 8.3 megawatts of power.

Figure 2:
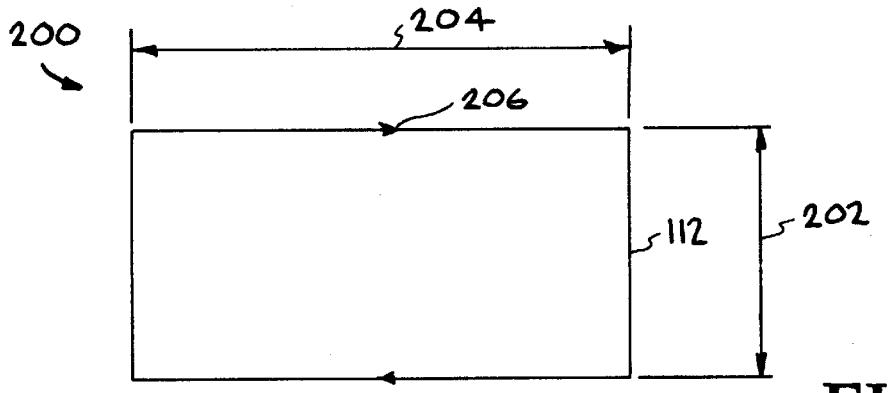
FIG. 2 is a pictorial diagram of one embodiment of a levitation coil.

FIG. 2 is a pictorial diagram 200 of one embodiment of one of the levitation coils 112. The levitation coil 112 is an electrically closed loop coil having a height 202 and a width 204. At a particular instant of time, induced current flowing through the levitation coil 112 in a direction shown by an arrow 206 is designated as I1.

Figure 3:
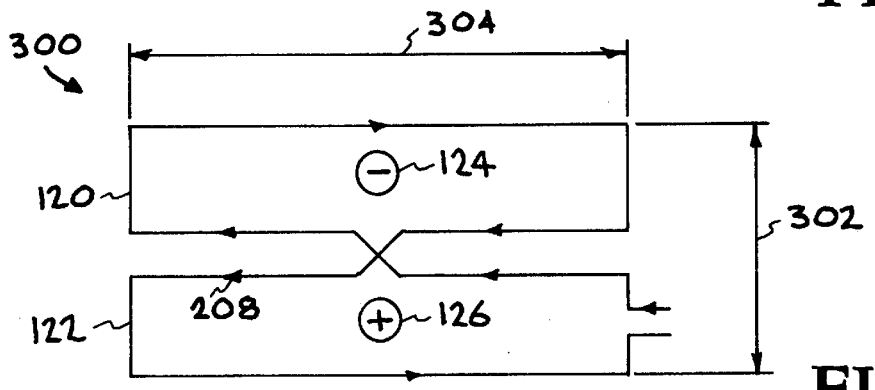
FIG. 3 is a pictorial diagram of one embodiment of a drive coil.

FIG. 3 is a pictorial diagram 300 of one embodiment of the drive coils 114. The drive coil 114 is an electrically open loop coil including the upper and lower drive coils 120 and 122, as shown, and receiving current 12 from the drive circuit 106. Drive current flowing at a particular instant of time through the upper drive coil 120 in a direction shown by an arrow 206 is designated as 13, and drive current flowing through the lower drive coil 122 in a direction shown by an arrow 208 is designated as 14. Using the right-hand-rule, current 13 generates the upper magnetic flux 124 directed into the diagram 300 and designated by a minus sign. Current 14 generates the lower magnetic flux 126 directed out of the diagram 300 and designated by a plus sign. Due to opposition of currents 13 and 14, currents that would have been present in response to the upper magnetic flux 124 in the levitation coil 112 are canceled out by an opposite current induced by the lower magnetic flux 126 in the levitation coil 112.

This flux canceling effect experienced by the levitation coil 112 is maximized when: the drive coil 114 has a height 302 less than or equal to the height 202 of the levitation coil 112, and a width 304 less than or equal to the width 204 of the levitation coil 112; the upper and lower drive coils 120 and 122 are symmetrical and fall within a same plane; and the drive circuit 106, upper drive coil 120, and lower drive coil 122 are connected in series, so that currents I2, I3, and I4 are equivalent. Those skilled in the art however will recognize that alternate embodiments of the apparatus 100 can achieve some degree of flux cancellation even though none of the above criteria are met. In addition, alternate embodiments of the apparatus 100 can incorporate multiple upper and lower drive coils depending on various levitation, drive, and canceling effects required by a particular application.

Figure 4:
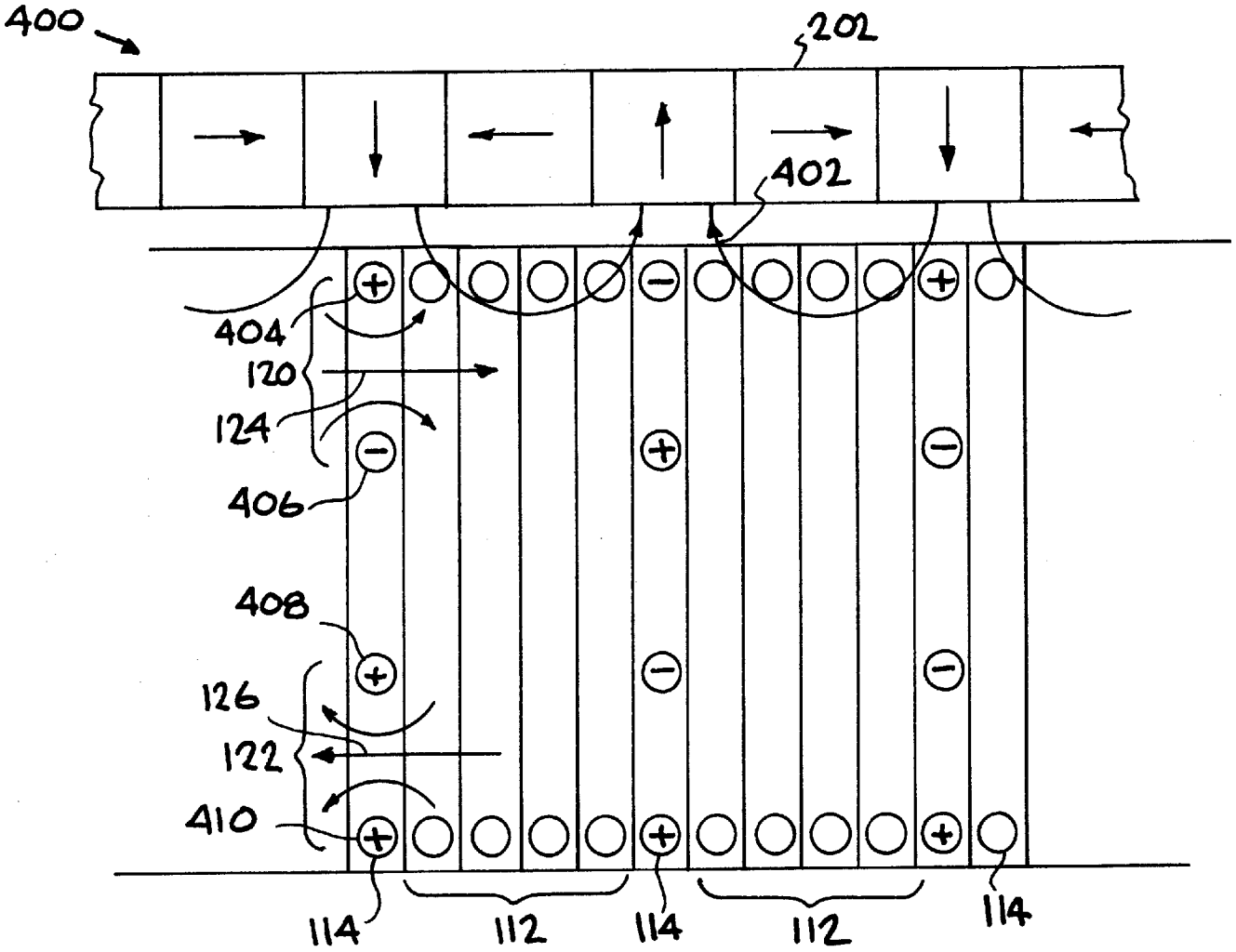
FIG. 4 is a pictorial diagram of a side view of part of the apparatus.

FIG. 4 is a pictorial diagram 400 of a side view of part of the apparatus 100. The diagram 400 shows end-on views of the pole array 102, the levitation coils 112, and the drive coils 114. During operation of the apparatus 100, the pole array 102 passes over the levitation coils 112 which "cut" magnetic field lines 402 created by the Halbach configuration of the pole array 102, thus effecting levitation. Current 13 flowing out of 404 and into 406 the diagram 400 in the upper drive coil 120 creates the upper magnetic flux 124, which interacts with the magnetic field lines 402 on the pole array 102 to effect motion of the pole array 102. Current 14 flowing into 408 and out of 410 in the lower drive coil 122 creates the lower magnetic flux 126, which interacts with the upper magnetic flux 124 to effect flux cancellation in the levitation coils 112. Due to the exponential attenuation of the magnetic field lines 402 of the pole array 102, only the upper magnetic flux 124 significantly interacts with the magnetic field lines 402, while the lower magnetic flux 126 neither significantly interacts with nor significantly interferes with either levitation or propulsion of the pole array 102.

Figure 5:
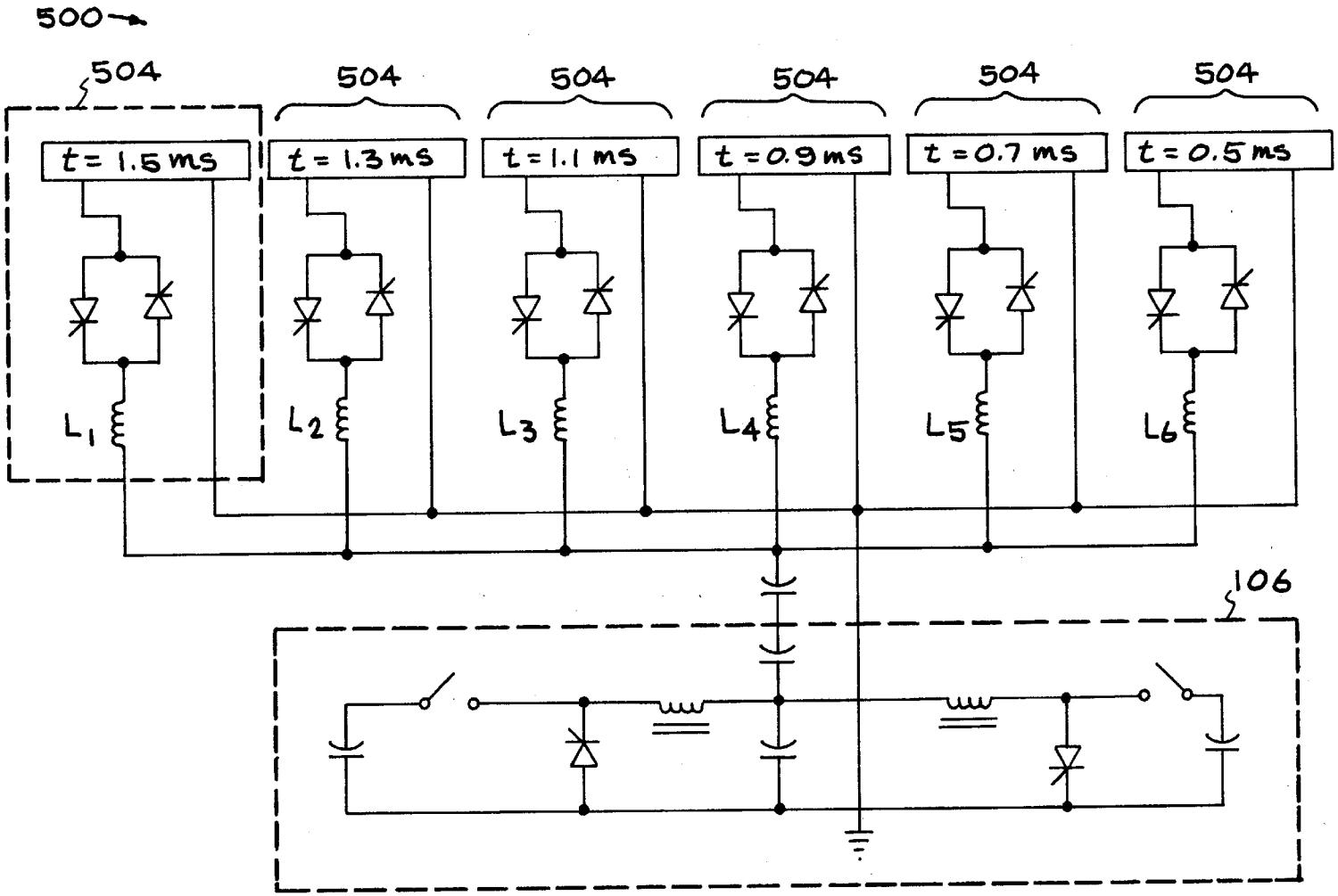
FIG. 5 is one embodiment of a circuit diagram for the apparatus.

FIG. 5 is one embodiment of a circuit diagram 500 for the apparatus 100. An exemplary drive circuit 502, and set of six drive coils 504 are shown.

Figure 6:
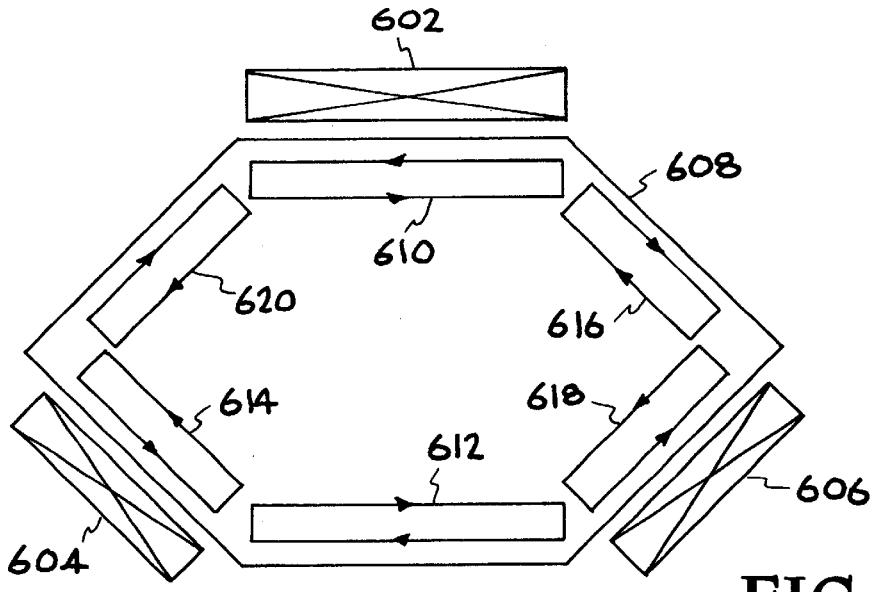
FIG. 6 is a pictorial diagram of an end-on view of a second apparatus for reducing inductive coupling between levitation and drive coils according to a second embodiment of the present invention.

FIG. 6 is a pictorial diagram of an end-on view of a second apparatus 600 for reducing inductive magnetic flux coupling between levitation and drive coils according to a second embodiment of the present invention. The second apparatus 600 includes a first, second, and third pole array 602, 604, and 606 positioned about a levitation coil 608. The pole arrays are in a Halbach configuration and are preferably attached to a second object (not shown). The first array 602 provides levitation for the second object, while the second and third arrays 604 and 606 provide centering forces. Three symmetrically placed and shaped pairs of drive coils are also included in this design. A first drive coil pair consists of an upper drive coil 610 for driving the second object using the first pole array 602 and a lower drive coil 612 for providing a canceling magnetic flux to the upper drive coil 610. A second drive coil pair consists of a drive coil 614 for driving the second object using the second pole array 604 and a drive coil 616 for providing a canceling magnetic flux to the drive coil 614. A third drive coil pair consists of a drive coil 618 for driving the second object using the third pole array 606 and a drive coil 620 for providing a canceling magnetic flux to the drive coil 618. Those skilled in the art will recognize many other geometries using levitation coils and drive coils are possible depending upon design requirements of any particular system. levitation coil and drive coil symmetry, while preferred, is not required.

Figure 7:
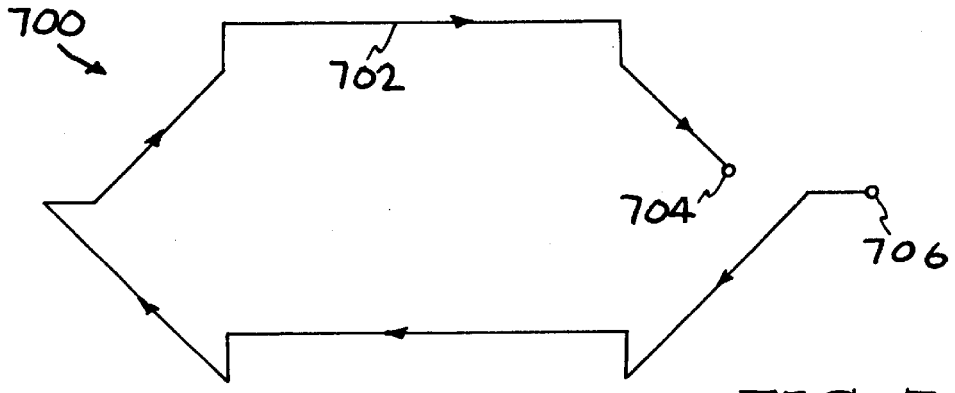
FIG. 7 is an pictorial layout of a first electric path for constructing the drive coils of the second apparatus.

FIG. 7 is an pictorial layout 700 of a first electric path 702 for constructing the drive coils 610 through 620 of the second apparatus 600. The first electric path 702 is shown by a solid line. The first electric path 702 includes a first end 704 and a second end 706.

Figure 8:
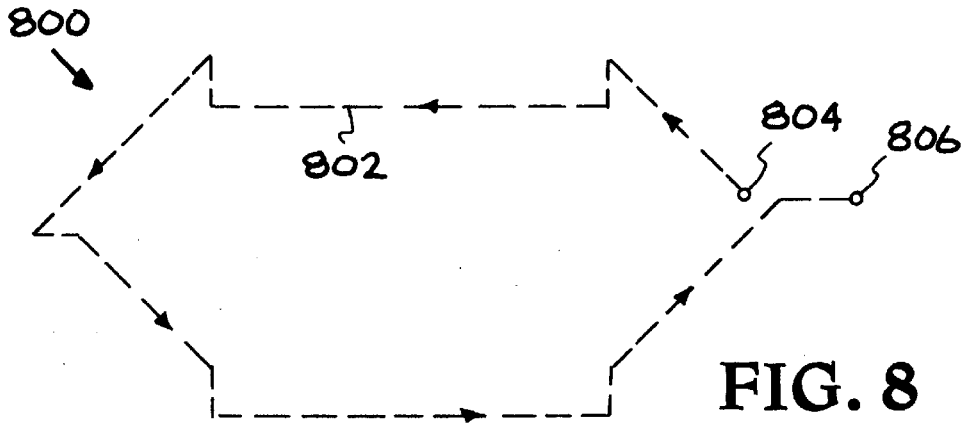
FIG. 8 is a pictorial layout of a second electrical path for constructing the drive oils the second apparatus.

FIG. 8 is a pictorial layout 800 of a second electrical path 802 for constructing the drive coils 610 through 620 of the second apparatus 600. The second electric path 802 is shown by a dashed line. The second electric path 802 includes a first end 804 and a second end 806.

Figure 9:
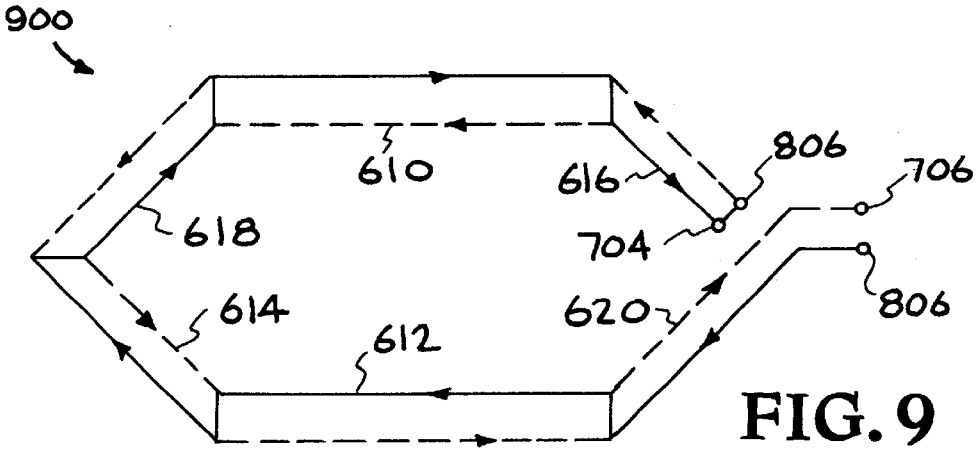
FIG. 9 is a pictorial diagram of the drive coils of the second apparatus.

FIG. 9 is a pictorial layout 900 of the drive coils 610 through 620 of the second apparatus 600. The drive coils 610 through 620 are nearly coplanar, being separated axially by a twin sheet of insulation. They are constructed by electrically connecting the first end 704 of the first electric path 702 to the first end 804 of the second electric path 802. The second ends 706 and 806 are then connected to a drive circuit (not shown) which sends current pulses through the drive coils 610 through 620.

While one or more embodiments of the present invention have been described, those skilled in the art will recognize that various modifications may be made. Variations upon and modifications to these embodiments are provided by the present invention, which is limited only by the following claims.

What is claimed is:

1. An apparatus for magnetic propulsion, the apparatus comprising:

a pole array having a magnetic field;

a levitation coil having a current induced in response to motion of the magnetic field of the pole array, an induced magnetic field coupled to levitate the pole array, and an axial centerline;

a first drive coil having a magnetic field coupled to drive the pole array and having a parasitic magnetic flux which induces a primary parasitic current in the levitation coil;

a second drive coil having a compensating magnetic flux to attenuate the primary parasitic current in the levitation coil; and the first and second drive coils being fixedly positioned in symmetry about the axial centerline when the magnetic field induced in the levitation coil is coupled to levitate the pole array.

2. The apparatus of claim 1 wherein the pole array is configured as a Halbach array.

3. The apparatus of claim 1 wherein the first and second drive coils fall within a planar region.

4. The apparatus of claim 1 wherein the first and second drive coils are electrically coupled in series.

5. The apparatus of claim 4 wherein the levitation coil produces a second magnetic field that induces a first parasitic current in the first drive coil and a second parasitic current in the second drive coil; and the first parasitic current opposes the second parasitic current, whereby the electric coupling in series of the first and second drive coils attenuates a parasitic effect of the second magnetic field on a common current flowing through the first and second drive coils.

6. The apparatus of claim 1 wherein:

the first drive coil includes a set of segments positioned at a first distance from the pole array;

the second drive coil includes a set of segments positioned at a second distance from the pole array; and the second distance is greater than the first distance.

7. The apparatus of claim 1 wherein the first and second drive coils are geometrically symmetric.

8. The apparatus of claim 1 wherein:

the levitation coil has an outside perimeter; and the first and second drive coils are located within the outside perimeter.

9. The apparatus of claim 1 further comprising:

a second pole array having a magnetic field; and a centering coil having a current induced in response to motion of the magnetic field of the second pole array.

10. The apparatus of claim 1 wherein:

the levitation and drive coils are coupled into a track configuration.

11. The apparatus of claim 1 further comprising:

an object coupled to the pole array.

12. A method for magnetic propulsion, comprising the steps of:

generating a magnetic field with a pole array;

inducing current in a levitation coil in response to motion of the magnetic field of the pole array causing levitation of the pole array;

generating a changing magnetic field with a first drive coil for propelling an object;

generating a compensating magnetic field with a second drive coil for attenuating parasitic effects of the changing magnetic field of the first drive coil on the current in the levitation coil; and fixedly and symmetrically positioning the first and second drive coils about an axial centerline through the levitation coil when the magnetic field induced in the levitation coil is coupled to levitate the pole array.

13. The method of claim 12 further including the step of configuring the pole array as a Halbach array.

14. The method of claim 12 further including the step of orienting the first and second drive coils within a geometric plane.

15. The method of claim 12 further including the step of electrically coupling the first and second drive coils in series.

16. The apparatus of claim 15, further including the step of generating opposing first and second parasitic currents in said first and second drive coils, respectively, for attenuating effects of a changing magnetic field generated by the levitation coil on a common current flowing through the electrically coupled first and second drive coils.

17. The method of claim 12 further including the step of positioning a majority of the first drive coil closer to the pole array than a majority of the second drive coil.

18. The method of claim 12 further including the step of selecting first and second drive coils which are symmetric.

19. The method of claim 12 wherein the levitation coil has an outside perimeter, further including the step of:

locating the first and second drive coils within the outside perimeter.

20. The method of claim 12 further including the step of configuring the levitation and drive coils into a track configuration.

21. An apparatus for magnetic propulsion, comprising;

means for generating a magnetic field with a pole array for levitating an object;

means for inducing current in a levitation coil in response to motion of the magnetic field of the pole array, and for inducing a magnetic field coupled to levitate the pole array;

means for generating a changing magnetic field with a first drive coil for propelling the object;

means for generating a compensating magnetic field with a second drive coil for attenuating parasitic effects of the changing magnetic field of the first drive coil on the current in the levitation coil; and the first and second drive coils being fixedly positioned in symmetry about an axial centerline through the levitation coil when the magnetic field induced in the levitation coil is coupled to levitate the pole array.

22. The apparatus of claim 21 further comprising means for configuring the pole array as a Halbach array.

23. The apparatus of claim 21 further comprising means for orienting the first and second drive coils within a geometric plane.

24. The apparatus of claim 21 further comprising means for electrically coupling the first and second drive coils in series.

25. The apparatus of claim 24 further comprising:

the levitation coil producing a second magnetic field that induces a first parasitic current in the first drive coil and a second parasitic current in the second drive coil; and the first parasitic current opposes the second parasitic current, whereby the electric coupling in series of the first and second drive coils attenuates a parasitic effect of the second magnetic field on a common current flowing through the first and second drive coils.

26. The apparatus of claim 21 further comprising means for positioning a majority of the first drive coil closer to the pole array than a majority of the second drive coil.

27. The apparatus of claim 21 further comprising means for selecting first and second drive coils which are symmetric.

28. The apparatus of claim 21, wherein the levitation coil has an outside perimeter, further comprising means for locating the first and second drive coils within the outside perimeter.

29. The apparatus of claim 21 further comprising means for configuring the levitation and drive coils into a track configuration.

30. An apparatus for magnetic propulsion, the apparatus comprising:

a pole array having a magnetic field;

a levitation coil having a current induced in response to motion of the magnetic field of the pole array;

a first drive coil having a magnetic field coupled to drive the pole array and having a parasitic magnetic flux which induces a primary parasitic current in the levitation coil;

a second drive coil having a compensating magnetic flux to attenuate the primary parasitic current in the levitation coil;

the levitation coil having an outside perimeter; and the first and second drive coils being located within the outside perimeter.

31. An apparatus for magnetic propulsion, comprising;

means for generating a magnetic field with a pole array for levitating an object;

means for inducing current in a levitation coil in response to motion of the magnetic field of the pole array;

means for generating a changing magnetic field with a first drive coil for propelling the object;

means for generating a compensating magnetic field with a second drive coil for attenuating parasitic effects of the changing magnetic field of the first drive coil on the current in the levitation coil;

the levitation coil having an outside perimeter; and means for locating the first and second drive coils within the outside perimeter.

* * * * *